US008414361B2

(12) United States Patent
Nguyen et al.

(10) Patent No.: US 8,414,361 B2
(45) Date of Patent: Apr. 9, 2013

(54) SILICON CARBIDE, SAPPHIRE, GERMANIUM, SILICON AND PATTERN WAFER POLISHING TEMPLATES HOLDER

(76) Inventors: Phuong Van Nguyen, San Jose, CA (US); Thang Van Tran, San Jose, CA (US)

( * ) Notice: Subject to any disclaimer, the term of this patent is extended or adjusted under 35 U.S.C. 154(b) by 426 days.

(21) Appl. No.: 12/856,521

(22) Filed: Aug. 13, 2010

(65) Prior Publication Data

US 2012/0040595 A1 Feb. 16, 2012

(51) Int. Cl.
*B24B 7/00* (2006.01)

(52) U.S. Cl.
USPC ..... 451/285; 451/286; 451/287; 451/28; 451/290; 451/490

(58) Field of Classification Search ..... 451/29, 451/28, 41, 60, 285–290, 490
See application file for complete search history.

(56) References Cited

U.S. PATENT DOCUMENTS

| | | | | |
|---|---|---|---|---|
| 4,165,584 | A * | 8/1979 | Scherrer | 451/289 |
| 4,512,113 | A * | 4/1985 | Budinger | 451/397 |
| 4,962,618 | A | 10/1990 | Wylde | |
| 5,573,448 | A * | 11/1996 | Nakazima et al. | 451/41 |
| 5,647,789 | A * | 7/1997 | Kitta et al. | 451/41 |
| 5,788,560 | A * | 8/1998 | Hashimoto et al. | 451/288 |
| 6,612,905 | B2 | 9/2003 | Nguyen | |
| 6,645,049 | B2 * | 11/2003 | Nguyen | 451/29 |
| 6,666,948 | B2 | 12/2003 | Nguyen | |
| 6,733,367 | B1 * | 5/2004 | Nguyen | 451/29 |
| 8,182,315 | B2 * | 5/2012 | Nguyen | 451/72 |

* cited by examiner

*Primary Examiner* — Maurina Rachuba
(74) *Attorney, Agent, or Firm* — Michael I. Kroll

(57) ABSTRACT

A template for polishing Silicon Carbide, Sapphire, Germanium, Silicon and pattern wafers having a slurry inlet, channels, outlets and pockets for holding said wafers terminating in peripheral vacuum ports in order to facilitate an efficient flow of slurry over the semiconductor wafers during a polishing process.

16 Claims, 9 Drawing Sheets

SILICON CARBIDE, SAPPHIRE, GERMANIUM, SILICON AND PATTERN WAFER POLISHING TEMPLATES HOLDER

BACKGROUND OF THE INVENTION

Field of the Invention

The present invention relates generally to semiconductor wafers and, more specifically, to a device for holding a plurality of semiconductor wafers taken from the group of Silicon Carbide, Sapphire, Germanium, Silicon and pattern wafers for polishing while having a fluid conducted over said wafers by means of a central inlet having a plurality of channels extending therefrom to each wafer pocket, where the slurry moves via centripetal force to a vacuum outlet for evacuation.

While other wafer polishing devices may be suitable for the purposes for which they were designed, they would not be as suitable for the purposes of the present invention, as hereinafter described.

SUMMARY OF THE PRESENT INVENTION

Current industry polishing process provides slurry that flows from a tube in the center of the polishing head into the center of the polishing pad. From there, the slurry is spread throughout the polishing pad and templates with the wafers polished by the flowing slurry. Most of the slurry is swept off the polishing pad due to centripetal force of the spinning head. As an example, the current process of polishing wafers provides for a sample flow rate of 1000 millimeters onto the polishing table where 30% of the slurry acts upon a wafer while 70% goes to the drains.

The present invention provides an environmentally green process template wafer holder for the semiconductor wafers polishing industry by creating a template having a center hole for initial slurry flow into the CIG (Chemical Inducing Grooves) channels with additional holes created around the template surface for more slurry channels into CIG. Escape holes are created approximate the periphery for slurry or water to escape the template to prevent overflow of slurry or water. The slurry and/or water are extracted out of these holes by a vacuum that can be controlled to prevent contamination. Slurry channels into the wafer pockets of the template by the CIG and escapes by centripetal force through the CIG channels at a controlled speed whereby controlling the flow of slurry within the channels of the template produces better wafer contact and flatness with less slurry waste and less processing time saving power and therefore saving time and money.

A primary object of the present invention is to provide a template for polishing Silicon Carbide, Sapphire, Germanium, Silicon and pattern wafer.

Another object of the present invention is to provide a template for polishing Silicon Carbide, Sapphire, Germanium, Silicon and pattern wafers utilizing the centripetal forces of the spinning template to induct flow of a fluid over the held wafers.

Yet another object of the present invention is to provide a template for holding Silicon Carbide, Sapphire, Germanium, Silicon and pattern wafers having a central inlet with a plurality of channels for inducting fluid over said wafers.

Still yet another object of the present invention is to provide a template for polishing Silicon Carbide, Sapphire, Germanium, Silicon and pattern wafers having an inlet to introduce a fluid, channels to guide it, and outlets to relieve said fluid and a vacuum to evacuate it.

Another object of the present invention is to provide a template for polishing Silicon Carbide, Sapphire, Germanium, Silicon and pattern wafers having a plurality of channels designed specifically to produce maximum flow and efficiency.

Additional objects of the present invention will appear as the description proceeds.

The present invention overcomes the shortcomings of the prior art by providing a template for polishing Silicon Carbide, Sapphire, Germanium, Silicon and pattern wafers having a slurry inlet, channels, outlets and pockets for holding said wafers terminating in peripheral vacuum ports in order to facilitate an efficient flow of slurry over the semiconductor wafers during a polishing process.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
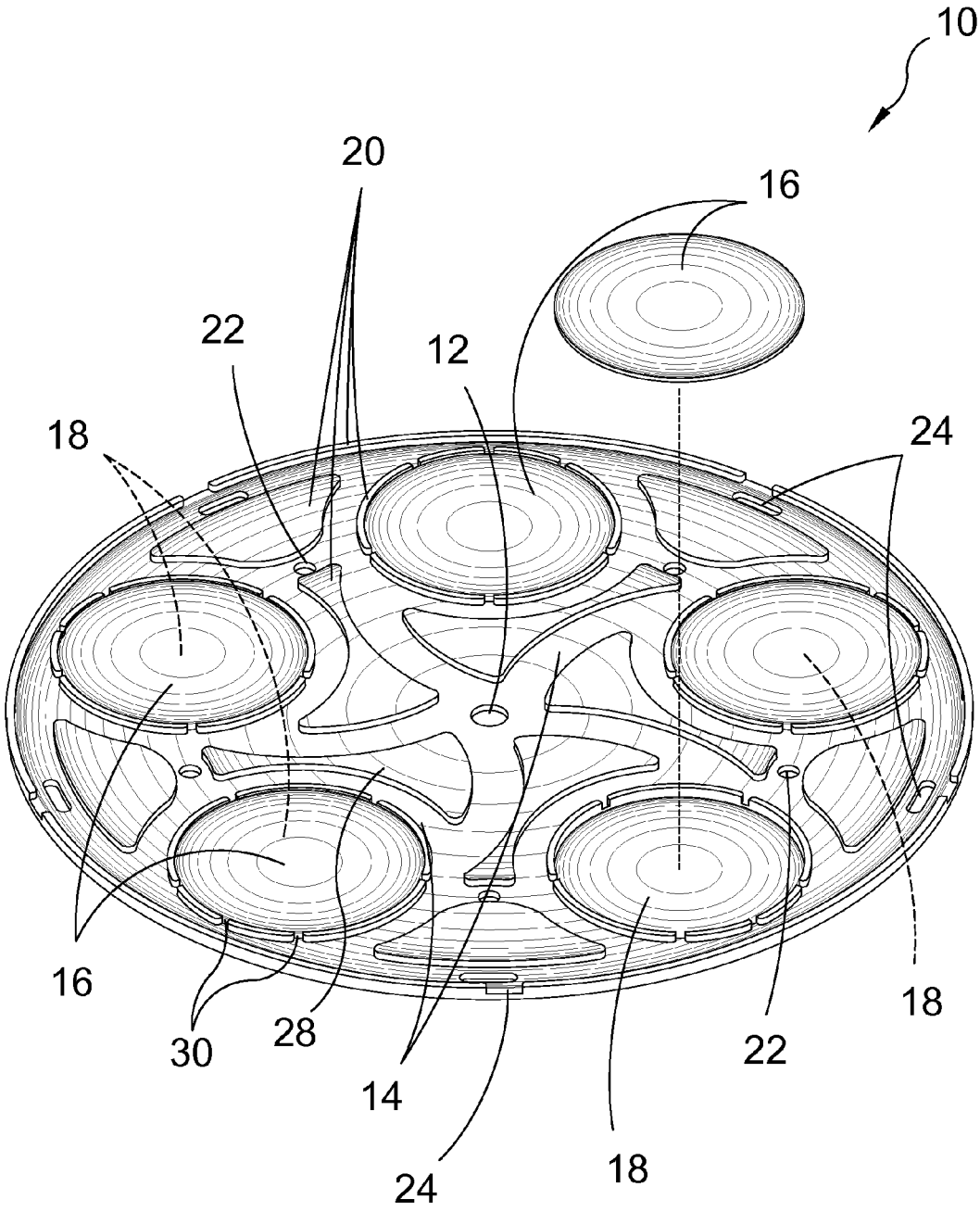
FIG. 1 is an illustrative view of the present invention in use.

Turning now descriptively to the drawings, in which similar reference characters denote similar elements throughout the several views, the figures illustrate the Silicon Carbide, Sapphire, Germanium, Silicon and pattern wafer polishing template of the present invention. With regard to the reference numerals used, the following numbering is used throughout the various drawing figures.

10 Silicon Carbide, Sapphire, Germanium, Silicon and pattern wafer polishing template of the present invention

12 slurry inlet

14 channel

16 semiconductor wafer

18 wafer pocket

20 template surface

22 slurry port
24 vacuum port
26 housing
28 directional guide
30 slurry passage
32 fluid course
34 slurry

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. The present invention is a template for polishing Silicon Carbide, Sapphire, Germanium, Silicon and pattern wafers 10 for manufacture in the electronics industry. Stemming from the templates center is a slurry input 12 that introduce s water, fluid or slurry (hereinafter referred to as slurry) to a plurality of channels 14 formed on the top template surface 20 and directional guides 28 to deliver said slurry through a plurality of slurry passages 30 notched into the walls of said wafer pockets 18 and evenly distribute and disperse said slurry upon wafers 16 disposed therein. There are apertures disposed within the channels 14 forming slurry outlets 22 to prevent slurry overflow. Additionally shown is the template loaded with four wafers 16 with a fifth being inserted into its designated placement. The slurry moves via centripetal force to vacuum ports 24 for evacuation.

Figure 2:
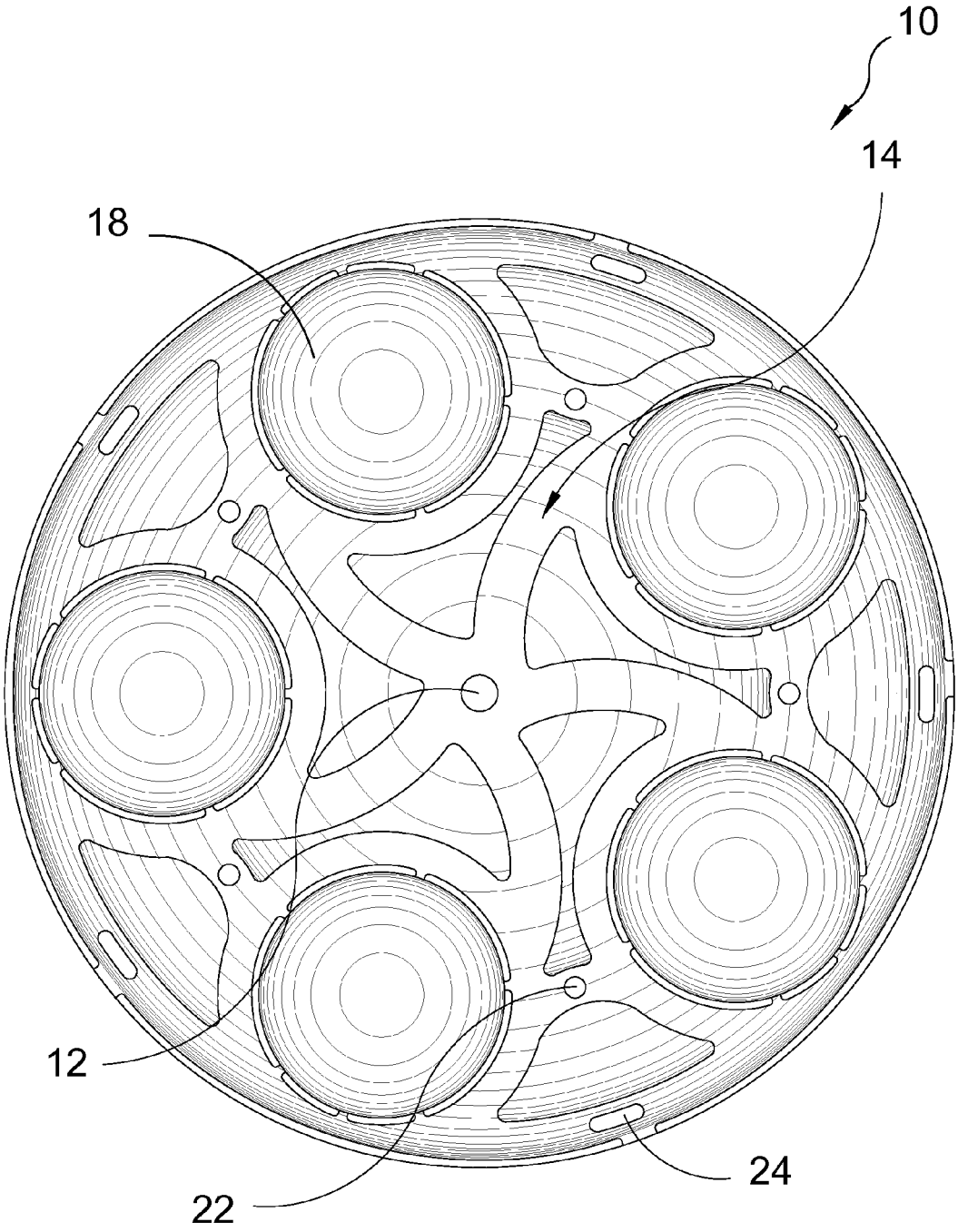
FIG. 2 is an illustrative view of the present invention.

FIG. 2 is an illustrative view of the present invention. The present invention is a template for polishing Silicon Carbide, Sapphire, Germanium, Silicon and pattern wafers 10 for manufacture in the electronics industry. The slurry enters the template through a centrally disposed inlet 12 into channels 14 with slurry outlets 22 to prevent overflow and the slurry enters the wafer pockets 18 to evenly distribute and disperse a polishing fluid upon its held wafers. The remaining slurry is then evacuated via centripetal force through vacuum ports 24.

Figure 3:
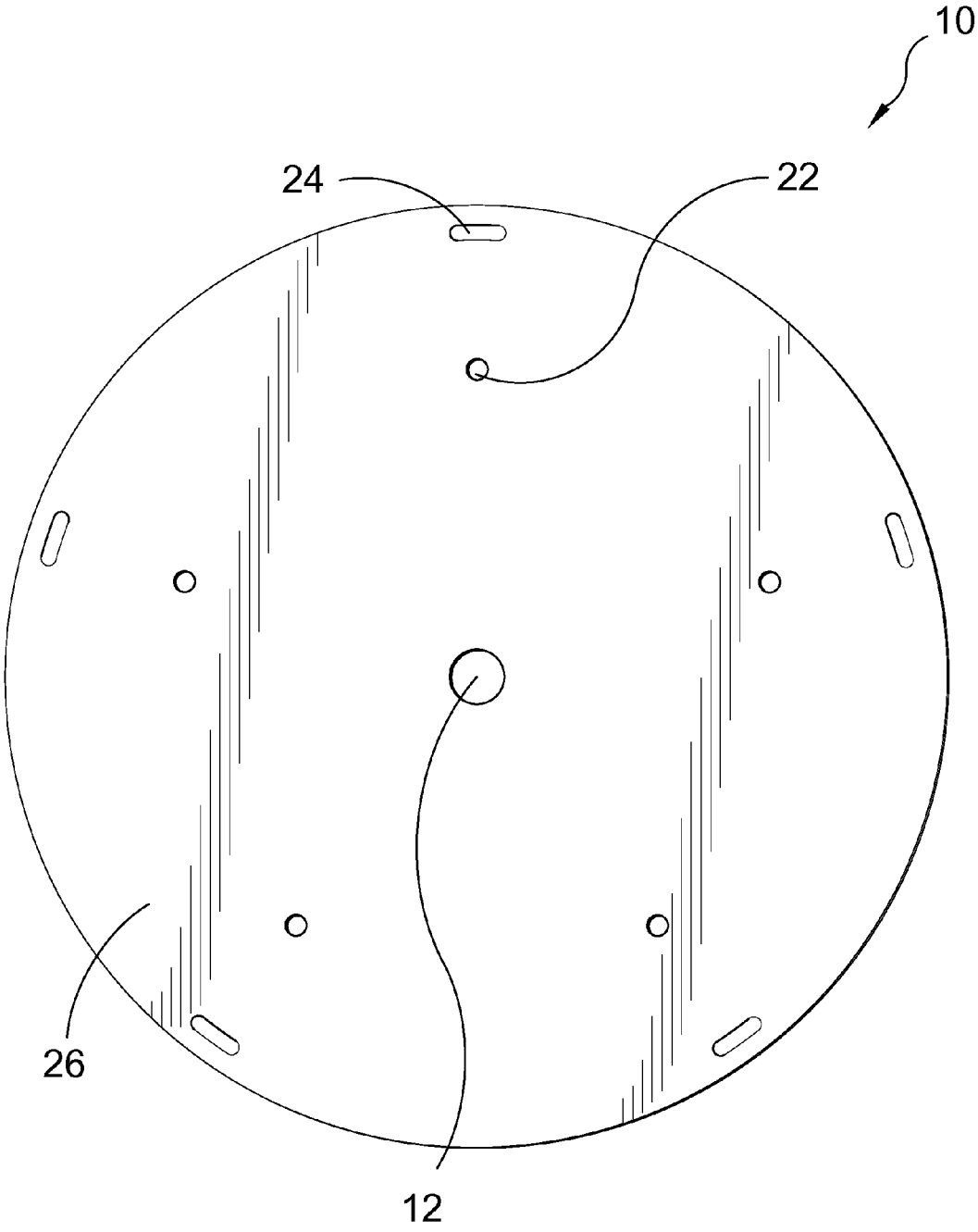
FIG. 3 is an illustrative view of the present invention.

FIG. 3 is an illustrative view of the present invention. Shown is the template for polishing Silicon Carbide, Sapphire, Germanium, Silicon and pattern wafers 10 having a housing 26 an inlet 12 in its center for receiving fluid therethrough with a plurality of outlets 22 that will allow excess fluid to centripetally drain through, along with a plurality of vacuum ports 24 for draining any remaining fluid out its periphery.

Figure 4:
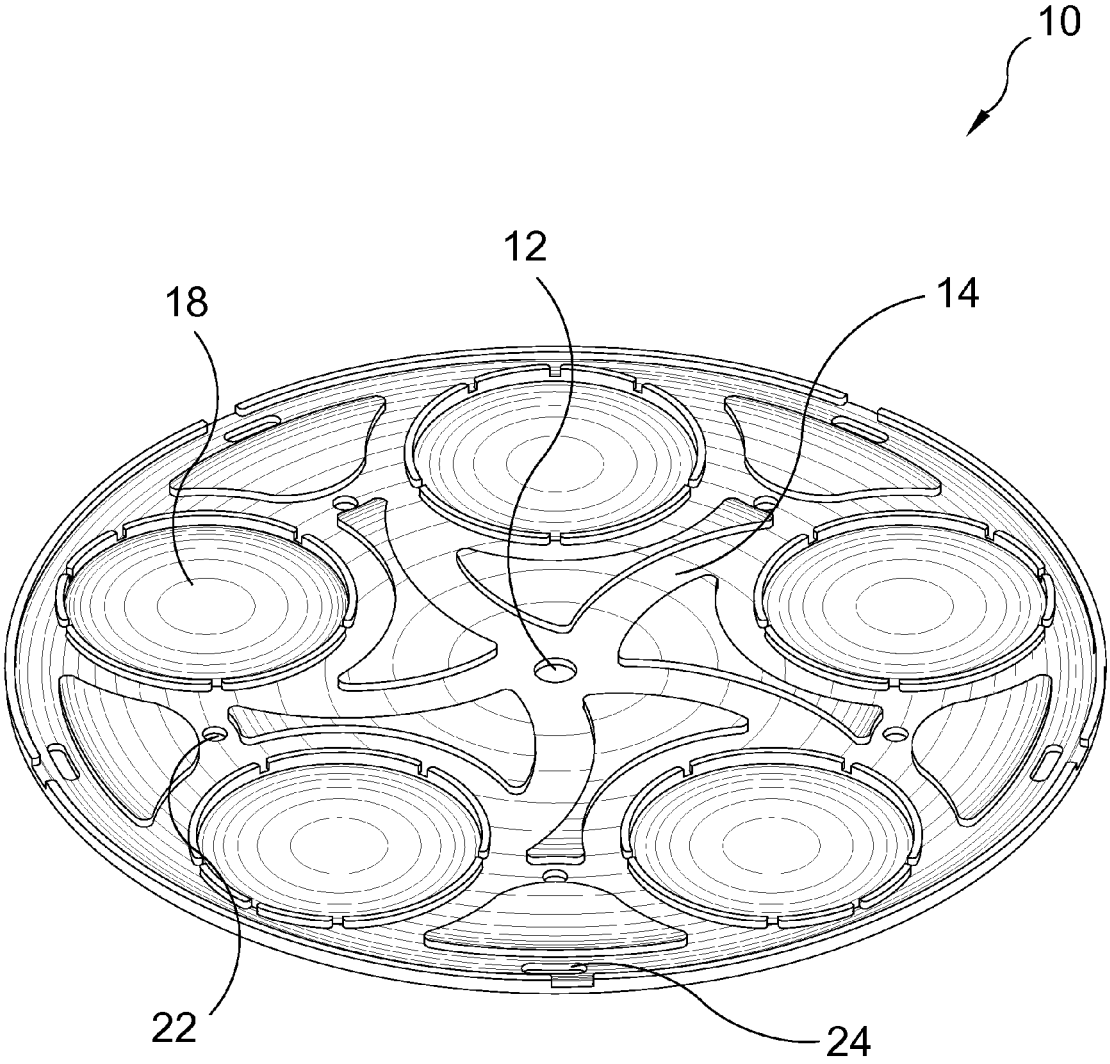
FIG. 4 is an illustrative view of the present invention.

FIG. 4 is an illustrative view of the present invention. The present invention is a template for polishing Silicon Carbide, Sapphire, Germanium, Silicon and pattern wafers 10 for manufacture in the electronics industry. Stemming from the slurry inlet 12 templates center and out to it's periphery are a plurality of channels 14 to direct the slurry to the overflow slurry outlets 22 and wafer pockets 18 and eventually to the vacuum ports 24.

Figure 5:
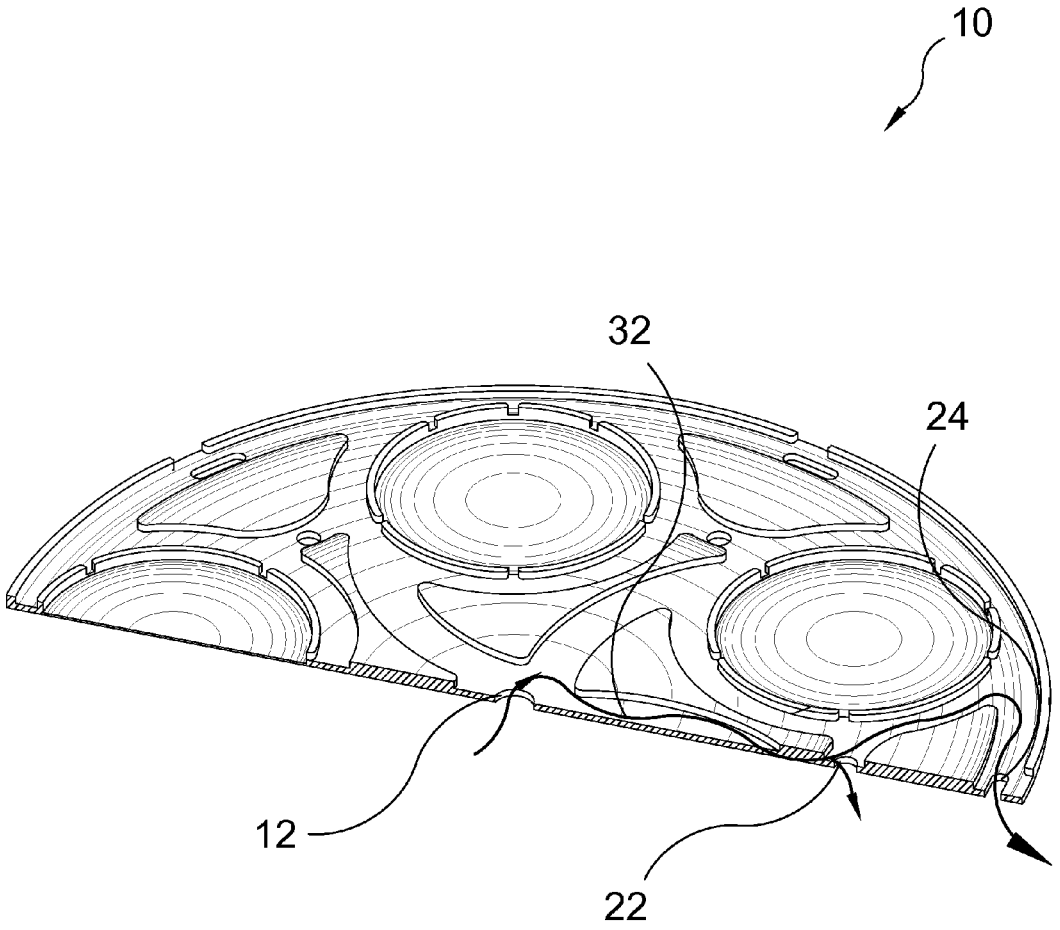
FIG. 5 is a sectional perspective view of the present invention.

FIG. 5 is a sectional perspective view of the template for polishing Silicon Carbide, Sapphire, Germanium, Silicon and pattern wafers 10 of the present invention. Shown is the fluid course 32 being used with the present invention, fluid is taken into the slurry inlet 12, can bleed out of the outlets 22 due to centripetal force and is then removed via a vacuum port 24.

Figure 6:
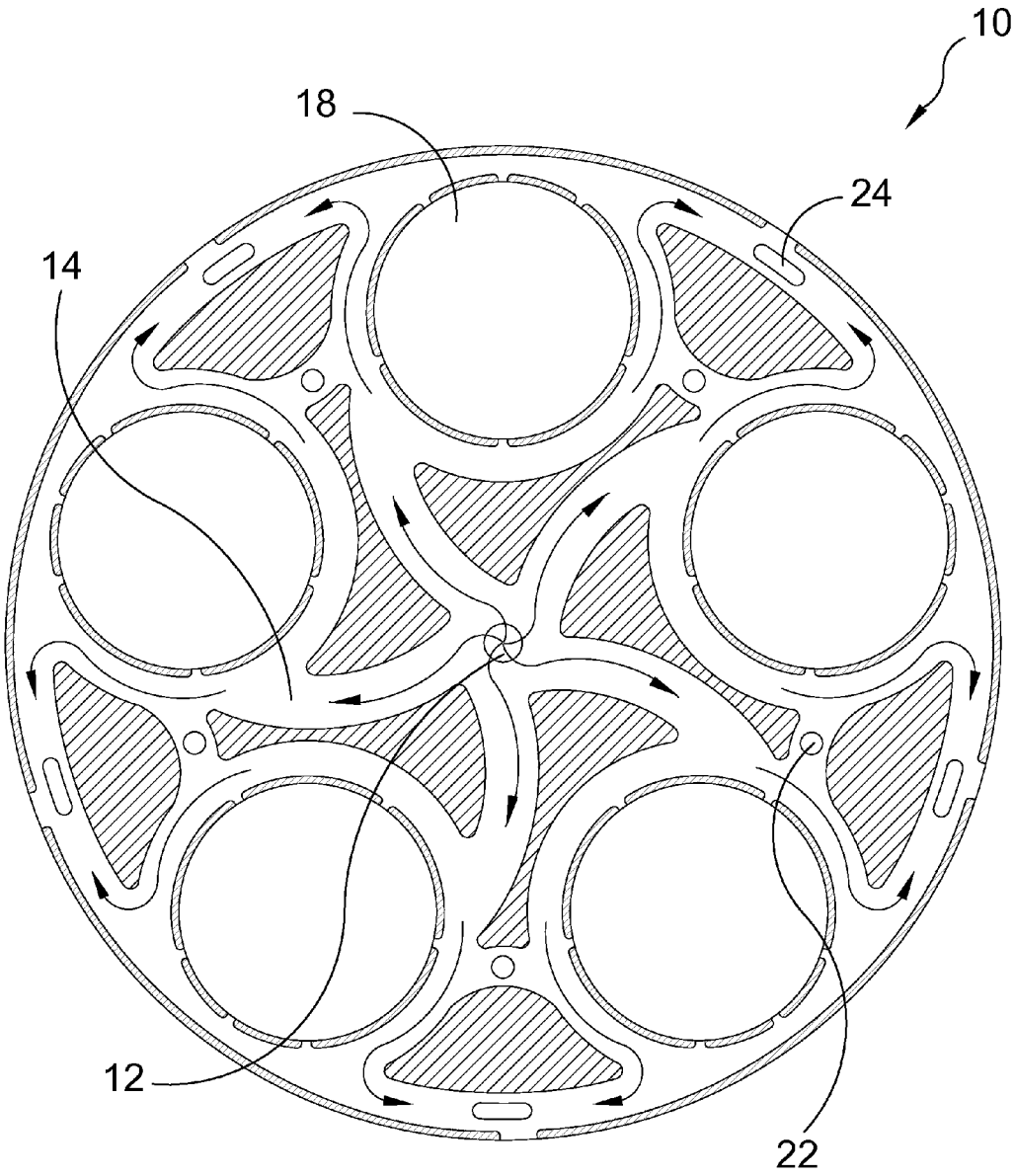
FIG. 6 is a top view of the present invention.

FIG. 6 is a top view of the present invention. The present invention is a template for polishing Silicon Carbide, Sapphire, Germanium, Silicon and pattern wafers 10. Shown is the relationship between the slurry inlet 12, channels 14, slurry outlets 22, wafer pockets 18 ant vacuum ports 24.

Figure 7:
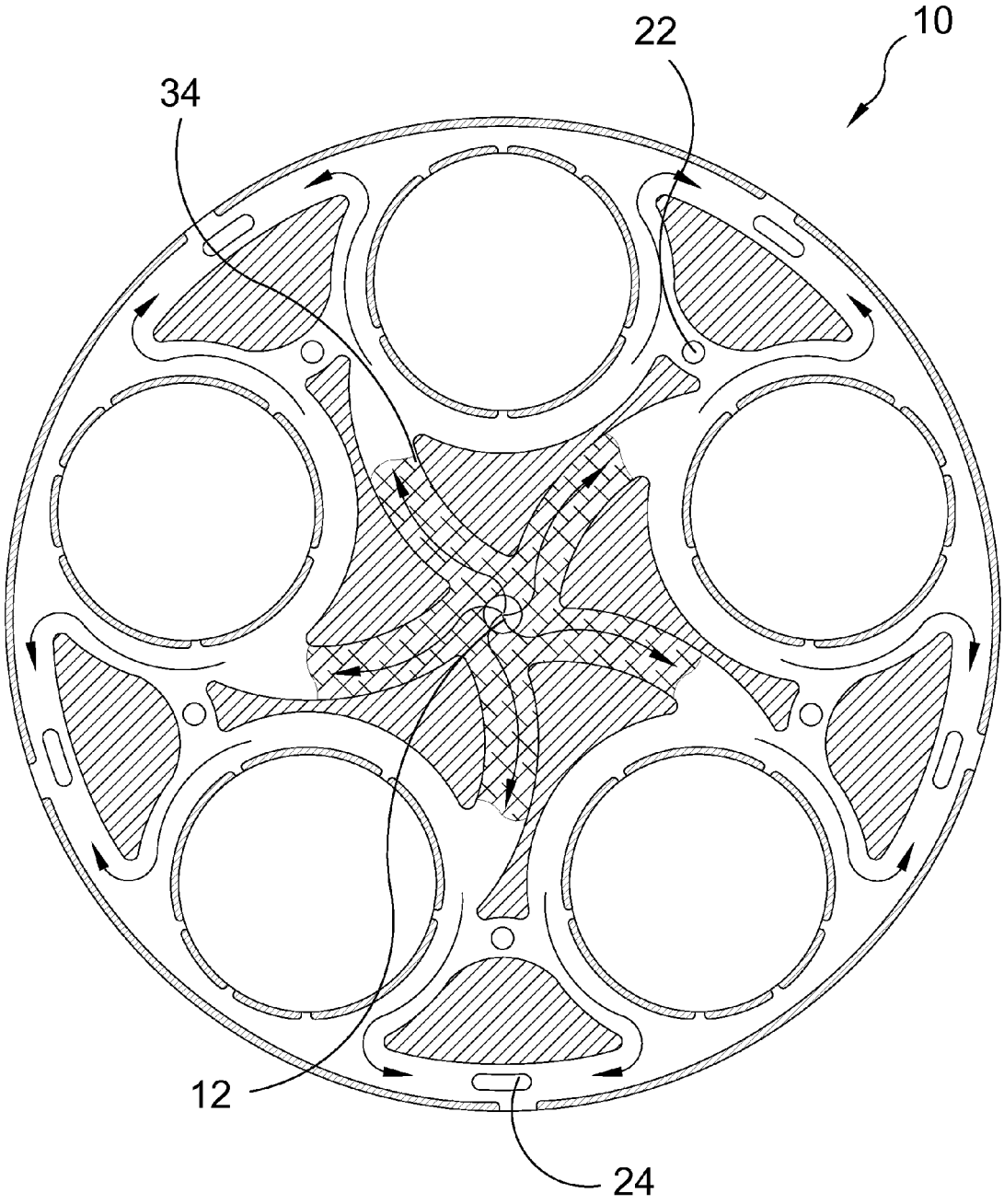
FIG. 7 is a top view of the present invention.

FIG. 7 is a top view of the template for polishing Silicon Carbide, Sapphire, Germanium, Silicon and pattern wafers 10 of the present invention. Shown is the coarse the slurry 34 takes while being used with the present invention, slurry 34 is taken in by the inlet 12, can bleed out of the outlets 22 due to centripetal force and is then removed via vacuum ports 24.

Figure 8:
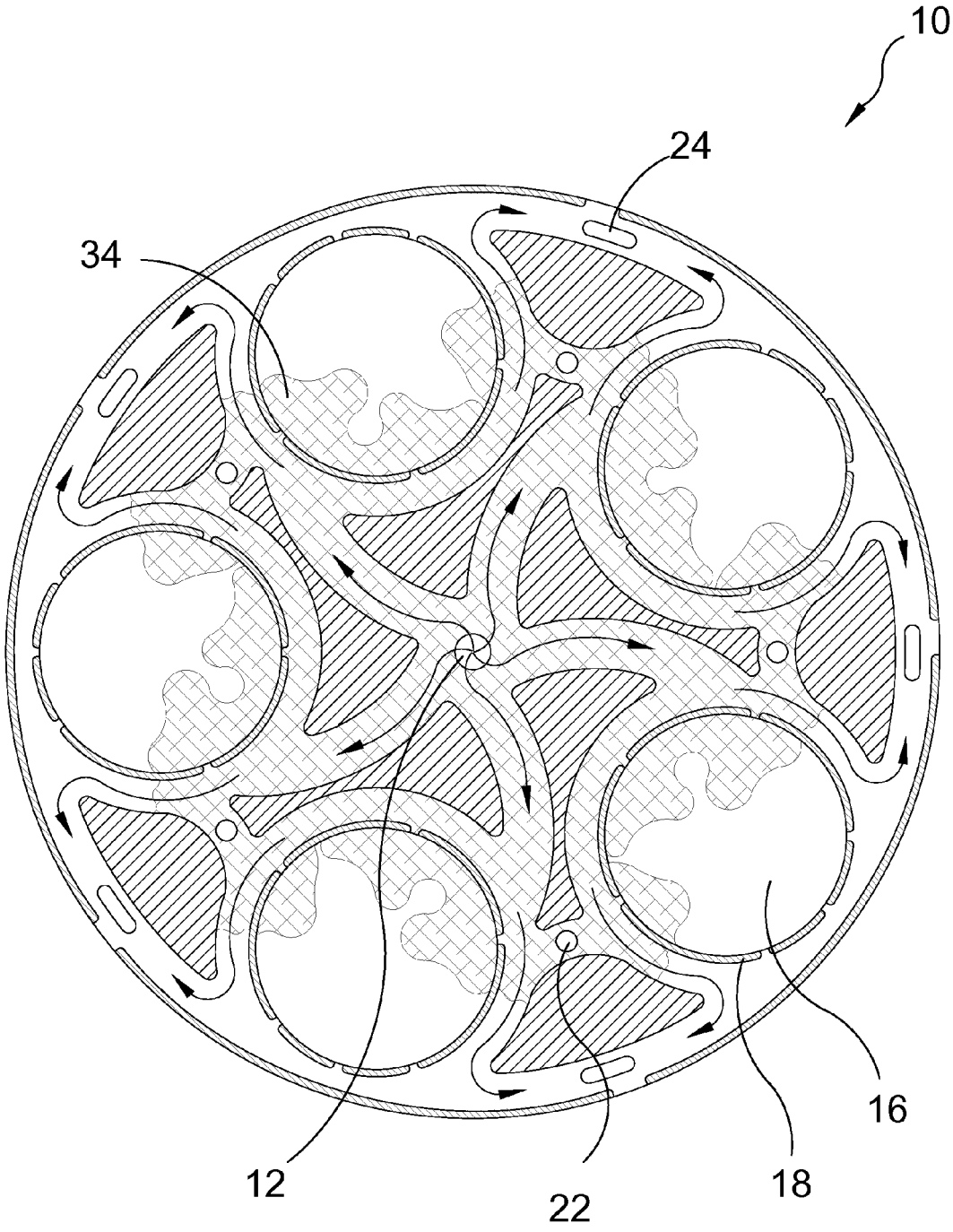
FIG. 8 is a top view of the present invention.

FIG. 8 is a top view of the template for polishing Silicon Carbide, Sapphire, Germanium, Silicon and pattern wafers 10 of the present invention. Shown is the course of the slurry 34 takes while being used with the present invention. Slurry 34 is taken in by the inlet 12, can bleed out of the outlets 22 due to centripetal force, enters the wafer pockets 18 to coat and polish the wafers 16 therein and is then removed via the vacuum ports 24.

Figure 9:
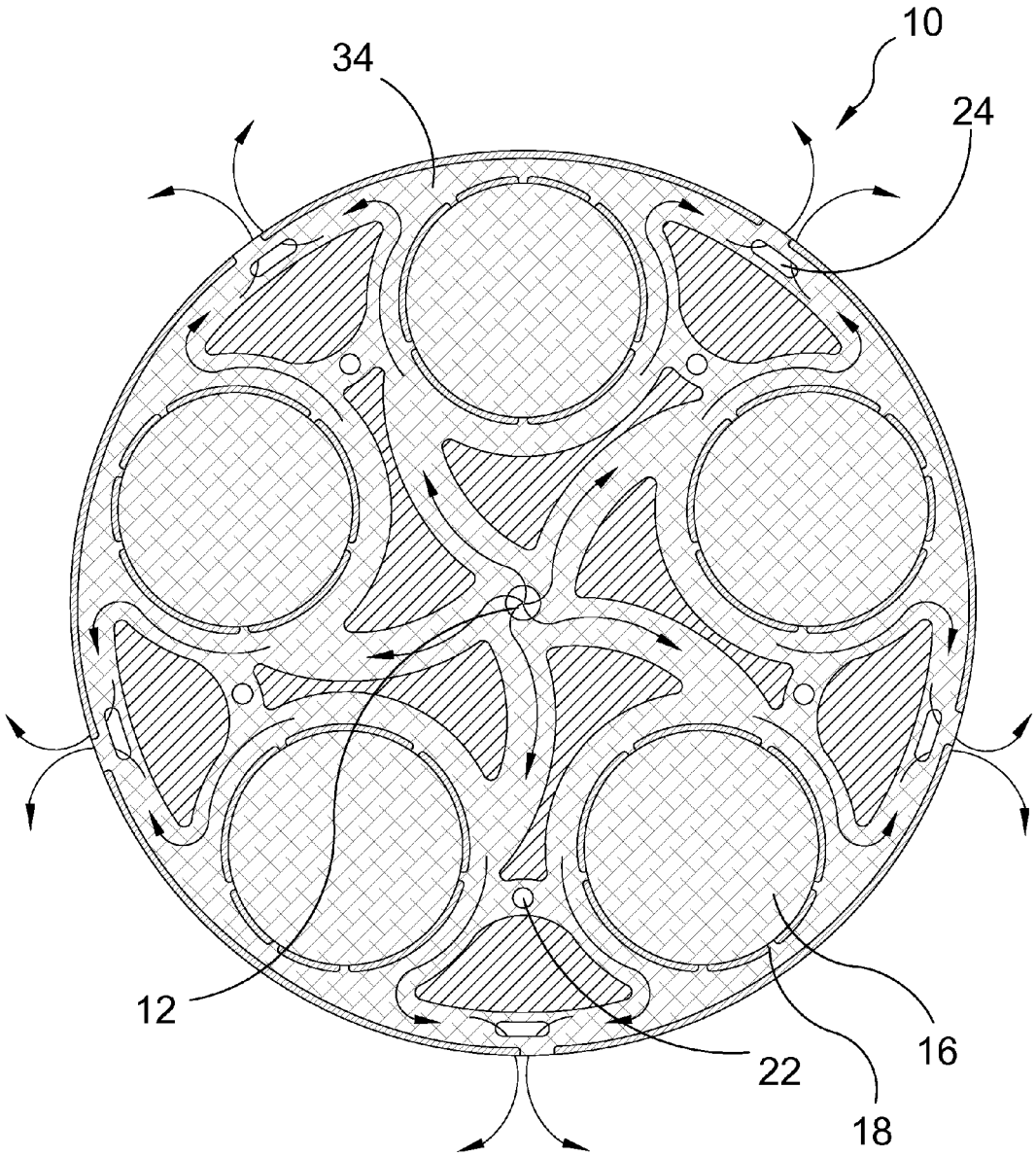
FIG. 9 is a top view of the present invention.

FIG. 9 is a top view of the template for polishing Silicon Carbide, Sapphire, Germanium, Silicon and pattern wafers 10 of the present invention. Shown is the course the slurry 34 takes while being used with the present invention, Slurry 34 is taken in by the inlet 12, can bleed out of the outlets 22 due to centripetal force, enters the wafer pockets 18 to coat and polish the wafers 16 therein and is then removed via the vacuum ports 24.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A template for polishing Silicon Carbide, Sapphire, Germanium, Silicon and pattern wafers for manufacture in the electronics industry comprising:

a) a rotatable template housing;
b) a top surface of said template within said housing;
c) a plurality of wafer pockets recessed into said top surface;
d) a centrally disposed slurry inlet port;
e) a plurality of outlet ports disposed between said inlet port and said wafer pockets;
f) a plurality vacuum ports peripherally disposed in said template; and
g) a plurality of channels recessed into said top surface to direct slurry flow therethrough.

2. The template for polishing Silicon Carbide, Sapphire, Germanium, Silicon and pattern wafers according to claim 1, wherein said channels lead from said slurry inlet port, over said slurry outlet port, through said wafer pocket and to said vacuum ports.

3. The template for polishing Silicon Carbide, Sapphire, Germanium, Silicon and pattern wafers according to claim 2 wherein said channels have a plurality of directional guides for directing the flow of said slurry therethrough.

4. The template for polishing Silicon Carbide, Sapphire, Germanium, Silicon and pattern wafers according to claim 3, wherein said slurry is introduced into said template through said centrally disposed inlet port.

5. The template for polishing Silicon Carbide, Sapphire, Germanium, Silicon and pattern wafers according to claim 4, wherein said slurry travels through said channels as directed by said directional guides.

6. The template for polishing Silicon Carbide, Sapphire, Germanium, Silicon and pattern wafers according to claim 5, wherein excess slurry egresses through said outlet ports.

7. The template for polishing Silicon Carbide, Sapphire, Germanium, Silicon and pattern wafers according to claim 6, wherein said slurry is introduced into said wafer pockets through a plurality of slurry passages notched into the walls thereof.

8. The template for polishing Silicon Carbide, Sapphire, Germanium, Silicon and pattern wafers according to claim 7, wherein said slurry abrades said wafers contained within said wafer pockets.

9. The template for polishing Silicon Carbide, Sapphire, Germanium, Silicon and pattern wafers according to claim 8, wherein most of the slurry is swept off of said wafer in said wafer pocket due to the centripetal force of the spinning housing.

10. The template for polishing Silicon Carbide, Sapphire, Germanium, Silicon and pattern wafers according to claim 9, wherein said slurry is extracted through said vacuum ports which can be controlled to prevent contamination.

11. The template for polishing Silicon Carbide, Sapphire, Germanium, Silicon and pattern wafers according to claim 10, wherein said semiconductor wafers is taken from the group of Silicon Carbide, Sapphire, Germanium, Silicon and pattern wafers.

12. A semiconductor wafer polishing template for polishing semiconductor wafers in an economical, environmentally friendly manner comprising;

a) a spinning head housing a template;

b) a plurality of wafer pockets for receiving semiconductor wafers therein having a plurality of slurry passages notched into the sidewall of each said wafer pocket;

c) a slurry inlet port for introducing slurry into said template;

d) a plurality of slurry outlet ports to provide points of egress for removing overflow slurry;

e) a plurality of vacuum ports for extracting said slurry from said template and is controllable to prevent contamination;

f) a plurality of channels leading from said inlet port to said wafer pockets and said slurry outlet ports and terminating at said vacuum ports; and g) a plurality of directional guides disposed within said channels to guide the directional flow of said slurry through said channels.

13. The semiconductor wafer polishing template for polishing semiconductor wafers in an economical, environmentally friendly manner according to claim 12, wherein said slurry is introduced into said template and starts its peripheral travel due to the centripetal force created by the spinning head.

14. The semiconductor wafer polishing template for polishing semiconductor wafers in an economical environmentally friendly manner according to claim 13, wherein the rate of travel of said slurry is adjustable by controlling the speed of rotation of said head.

15. The semiconductor wafer polishing template for polishing semiconductor wafers in an economical environmentally friendly manner according to claim 14, wherein controlling the flow of said slurry maximizes wafer contact and flatness and reduces slurry waste and processing time to save power.

16. The semiconductor wafer polishing template for polishing semiconductor wafers in an economical environmentally friendly manner according to claim 15, wherein said slurry is evacuated by said vacuum ports.

* * * * *